US008590185B1

(12) United States Patent
Jardine

(10) Patent No.: US 8,590,185 B1
(45) Date of Patent: Nov. 26, 2013

(54) CASUAL APPAREL ACCESSORIZING DEVICE AND METHOD

(76) Inventor: Jason Jardine, Fort Lauderdale, FL (US)

( * ) Notice: Subject to any disclaimer, the term of this patent is extended or adjusted under 35 U.S.C. 154(b) by 38 days.

(21) Appl. No.: 13/008,540

(22) Filed: Jan. 18, 2011

Related U.S. Application Data

(60) Provisional application No. 61/295,888, filed on Jan. 18, 2010.

(51) Int. Cl.
*G09F 21/02* (2006.01)

(52) U.S. Cl.
USPC ..... 40/586; 40/661.04; 24/104

(58) Field of Classification Search
USPC ..... 40/1.6, 586, 661.04, 661.07, 661.05; 63/20, 1.18; 24/3.1, 104
See application file for complete search history.

(56) References Cited

U.S. PATENT DOCUMENTS 4,183,159 A * 1/1980 Isaac ..... 40/1.6
4,604,819 A * 8/1986 Grey ..... 40/1.5
6,178,680 B1 * 1/2001 Sloot ..... 40/668
6,671,986 B2 * 1/2004 Reeves ..... 40/1.6
7,966,755 B1 * 6/2011 Reeves ..... 40/1.5
2005/0060925 A1 * 3/2005 Kaneko et al. ..... 40/661.04
2007/0193094 A1 * 8/2007 Noor ..... 40/661.04

* cited by examiner

*Primary Examiner* — Joanne Silbermann
*Assistant Examiner* — Christopher e Veraa
(74) *Attorney, Agent, or Firm* — Gold & Rizvi, P.A.; H. John Rizvi

(57) ABSTRACT

A system for decorating, customizing, personalizing and accessorizing a casual garment, such as jeans and other casual pants, skirts, shirts, jackets and the like. The adornments include at least one fixed subassembly attached to material of the apparel and one or more interchangeable decorative adornment covers for attachment to each fixed subassembly. The interchangeable decorative adornment covers can be offered having different images or designs including flowers, animals, letters, numbers, coins, etc. Additionally the casual apparel may include a pocket having a transparent central member and a backing member forming an insert receptacle. A common pocket receptacle is formed between the backing member and the garment material. A decorative insert in placed into the insert receptacle and is visible through the transparent pocket fascia. The interchangeable decorative adornment covers and decorative insert would be offered separately allowing the individual to characterize the garment as desired for each day.

7 Claims, 13 Drawing Sheets

CASUAL APPAREL ACCESSORIZING DEVICE AND METHOD

CROSS-REFERENCE TO RELATED APPLICATION

This Non-Provisional Utility application claims the benefit of U.S. Provisional Patent Application Ser. No. 61/295,888, filed on Jan. 18, 2010, which is incorporated herein in its entirety.

FIELD OF THE INVENTION

This invention relates generally to the accessorizing of apparel items including jeans, regular trousers, jackets, and the like. More specifically, the invention comprises accessorizing material and respective method including a plurality of removably attaching decorative covers that attach to receptacles affixed in a spatial arrangement about the material of casual apparel and a decorative insert for insertion into a respective pocket display receptacle having a transparent pocket fascia.

BACKGROUND OF THE INVENTION

Clothing is and manufactured of many different fabrics and qualities and offered in many form factors, each being directed for a specific fashion appearance. The various fashion categories include casual, sports, dress, formal, and the like. Some fashion can be directed towards costumes, cultural, and the like. Other fashion is directed toward daily wear.

Versatility of the garment offers another challenge for the consumer. In addition, a single garment may be used in different settings and combined with several different outfits to create a coordinated wardrobe. However, the garments remain mass produced and consumers are very limited with their styling options and any individualism results from the choice of colors, combinations, garment style or accessories, e.g., purse, shoes, cufflinks, watch, necklace, etc. In addition, purchasing multiple decorative garments can become cost prohibitive, e.g., the same shirt in every color.

Adornment to the apparel provides one means for individualizing an outfit. An individual purchases accessories which can include objects that are attached to the apparel, such as belts, pins, handkerchiefs, and the like or worn those that are independent of the apparel, such as pocketbooks, jewelry, hairpieces, shoes, and the like. Each accessory would be considered respective to the desired level of dress. Formal dress directs formal accessorization. Casual dress directs a more casual accessorization, and generally provides for a broader range of accessories.

One known means for individualizing a garment are decorative accessories for clothing items removably supported thereon by hook-and-loop type fasteners. Cuffs are removably secured to the distal ends of legs of pants, cuffs are removably secured to the distal ends of sleeves of tops, and collars are removably secured to neck openings of tops by the hook-and-loop type fasteners. Patches, which may be associated with nations or sports teams attending sports events, with characters and attractions at theme parks, etc. are removably attached to garments utilizing hook-and-loop type fasteners. Collectibles; pictures and other indicia identified with entertainers and other personalities; tickets, licenses and other items subject to inspect by authorities are removably displayed on garments utilizing hook-and-loop type fasteners.

There are also known jeans for children, which include one or more active play features usable while the jeans are being worn. These various features include a race course for a toy race car, a concealed pocket extractable to form a flag-like decoration, a window pocket, a secret tunnel pocket, a carry pouch convertible into a flat play area, and concealed knee pockets, which enable the user of jeans to display a puppet show using built-in features of the jeans, while worn by the user.

There are also some known embodiments for customizing the pockets of blue jeans, shirts, or other casual wear. For example, a mechanism whereby pants, particularly women's denim jeans, can be customized is known, and, which makes use of interchangeable rear outer pocket walls. The pockets differ in their embellishments on the outer pocket wall but not in the size of the outer pocket member. Each outer pocket member includes at least one attachment mechanism that is permanently fixed to a portion of the perimeter of the outer member and is provided to couple with the attachment mechanism that is permanently affixed to the garment.

Another embodiment for customizing pockets of jeans includes interchangeable outer patches, particularly in the position of the seat pocket. The garment and the portion of fabric constituting the outer patch have inter-engaging devices, for example, adhesive, a press-stud and a loop-hook fabric fastener for releasably securing the two together.

The present invention includes printed materials. Printed material can include common printed objects such as paper products, plastics, metallic sheets, and the like. Printing can be completed using screen printing, laser printing, transfer printing, and the like. Printing processes may be enhanced to include images presenting a three-dimensional appearance. One such technology is referred to as lenticular printing. Lenticular printing is a technology in which a lenticular lens is used to produce images with an illusion of depth. This type of printing creates images having objects that appear change or move as the image is viewed from different angles. A common example of lenticular printing would be a "prize" included in Cracker Jack snack boxes, where the images shows flipping or other animation effects such as winking eyes. Another example would be modern advertising graphics that change their image or message depending on the viewing angle. Recent advancements have significantly enhanced the quality and appearance of depth of the images.

Even though the above cited devices and methods for customizing pants, shirts and the like, address some of the needs of the market, an easy to install and exchange custom decorative display adornments and customizable rear pockets for casual garments is still desired.

SUMMARY OF THE INVENTION

This invention is directed to an accessorization apparatus and method of use for changeably adorning a casual garment or outfit. The accessorization apparatus comprises:

an interchangeable decorative adornment cover comprising an aesthetic cover portion and a concealed attachment feature; and a fixed decorative attachment receiving subassembly comprising:

- a fixed adornment attachment member comprising a mating attachment feature, and
- an attachment backing member, wherein the attachment backing member is affixed to the fixed adornment attachment member sandwiching material of a casual garment therebetween;

wherein the interchangeable decorative adornment cover is removably attached to the fixed adornment attachment member by engaging the concealed attachment feature and the mating attachment feature.

In a second aspect of the present invention, at least one of the interchangeable decorative adornment cover and the fixed adornment attachment member is fabricated of a pliant material.

In another aspect, the concealed attachment feature comprises an adornment attachment feature having a formation of an insertion pin and the fixed adornment attachment member comprises a mating attachment feature having a formation of a mating aperture for receiving and removably retaining the insertion pin.

In another aspect, the adornment attachment feature comprises a series of insertion pins, and the mating attachment feature comprises a series of mating apertures sized, located, and arranged to receive the series of insertion pins.

In another aspect, the concealed attachment feature comprises an adornment attachment feature having a formation of keyhole shaped recession in a rear surface of the interchangeable decorative adornment cover and the fixed adornment attachment member comprises a mating attachment feature having a formation of a mating flange for insertion into the keyhole shaped recession and removably retaining the interchangeable decorative adornment cover.

In another aspect, at least one of the interchangeable decorative adornment cover and the fixed adornment attachment member is fabricated of a pliant material allowing the keyhole or flange to deform for engagement.

In another aspect, the keyhole and respective flange are shaped allowing the flange to be inserted into the keyhole, and then twisted to secure the flange within the keyhole.

In another aspect, the fixed decorative attachment receiving subassembly further comprises an orientation member allowing the fixed adornment attachment member to be rotated.

In another aspect, the orientation member further comprises a rotational positioning interface for retaining the fixed adornment attachment member at a desired rotated angle.

In another aspect, the rotational positioning interface comprises at least one registration tooth and a series of mating orientation retaining recessions, the registration tooth and series of mating orientation retaining recessions being disposed between the orientation member and the fixed adornment attachment member.

In another aspect, the rotational positioning interface comprises at least one registration orientation retaining recession and a series of mating teeth, the at least one registration orientation retaining recession and series of mating teeth being disposed between the orientation member and the fixed adornment attachment member.

In another aspect, the fixed decorative attachment receiving subassembly further comprises at least one orientation retaining pin on a mating surface of a first member and a respective clearance on a mating surface of a mating member. In an exemplary embodiment, the first member is the orientation member and the mating member is the backing affixing member.

In another aspect, the backing affixing member and the orientation member area assembled, sandwiching the apparel material therebetween. The fixed adornment attachment member is then rotationally attached to either the backing affixing member or the orientation member.

In another aspect, the interchangeable decorative adornment covers can be shaped resembling flowers, animals, letters, numbers, coins, and the like.

The pocket adorning configuration comprises:

a pocket assembly comprising:

a pocket frame having a central opening, the pocket frame being assembled to an exterior surface of the apparel material along a lower edge and each of two side edges, a transparent pocket fascia attached to the pocket frame across the central opening to form a transparent outer surface of the pocket assembly, a pocket insert receptacle rear member assembled sandwiched between the pocket frame and the apparel material exterior surface forming an insert receptacle between the pocket frame and a common pocket between the apparel material exterior surface; and a decorative pocket insert sized to fit within the insert receptacle, wherein the decorative pocket insert is visible through the transparent pocket fascia.

In another aspect, the pocket assembly further comprises an insert receptacle cover flap providing a cover between the pocket frame and the pocket insert receptacle rear member to maintain the decorative pocket insert within the insert receptacle during use.

In another aspect, the pocket assembly further comprises a closure provided between the pocket frame and the pocket insert receptacle rear member to maintain the decorative pocket insert within the insert receptacle during use. The pocket closure may be a dense hook and loop closure interface, a snap interface, a hook and loop interface, and the like.

In another aspect, the pocket insert may be fabricated of a 3-dimensional imagery.

Accordingly, it is a primary object of the present invention to provide a system for adorning and individualizing a casual garment, for example, designer-type jeans, with interchangeable designs like flowers, animals, letters, numbers, coins, etc. The adornment may be changed based upon the wearer's mood, daily activities, and the like. This can include changing the interchangeable decorative adornment covers and/or the decorative pocket inserts.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

The preferred embodiments of the invention will hereinafter be described in conjunction with the appended drawings provided to illustrate and not to limit the invention, in which.

Figure 1:
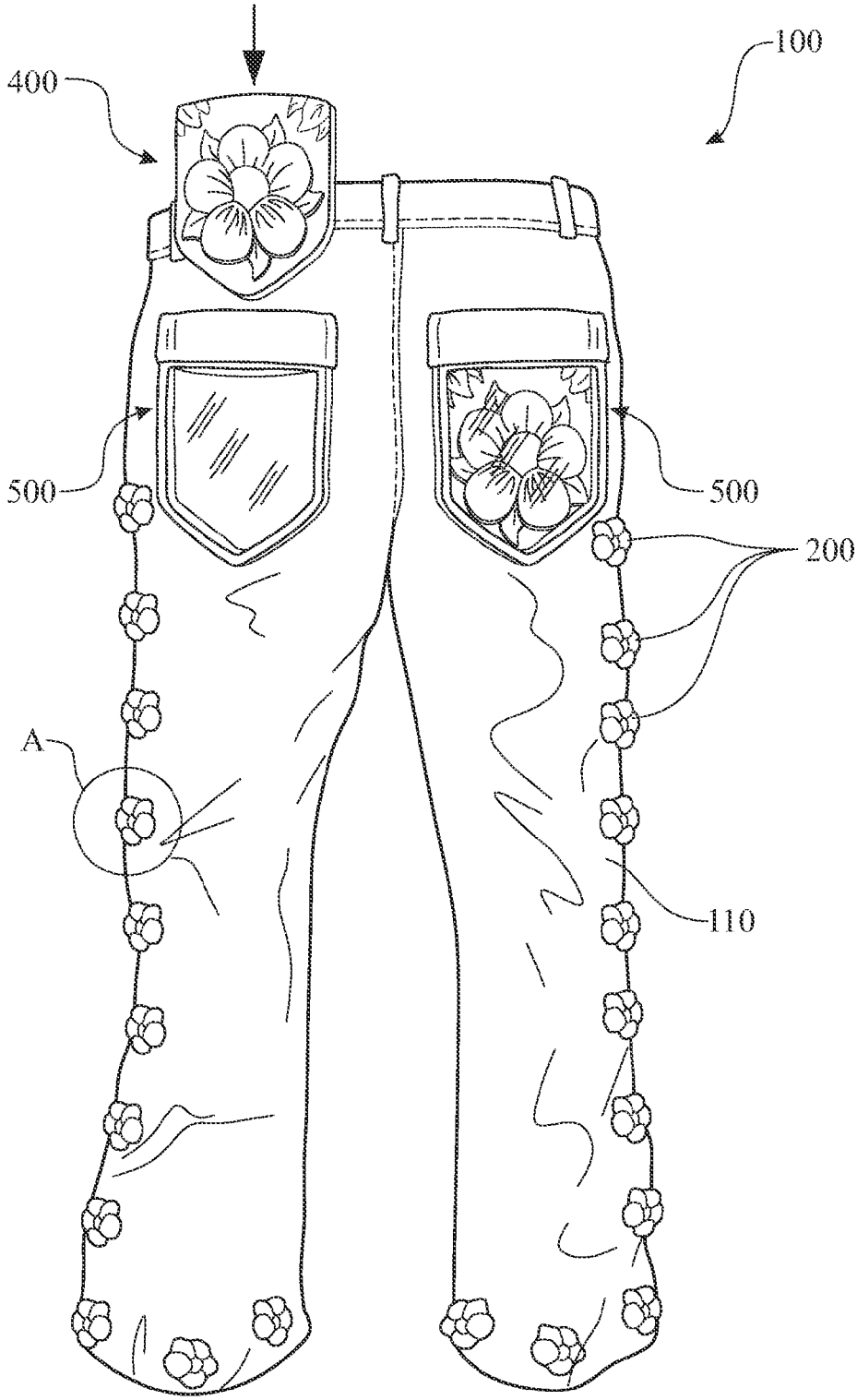
FIG. 1 presents a general perspective view of an exemplary embodiment of a pair of casual pants comprising a plurality of interchanging decorative adornment assemblies and an image enhancing pocket insert being inserted into an embellishment receiving pocket.
Figure 2:
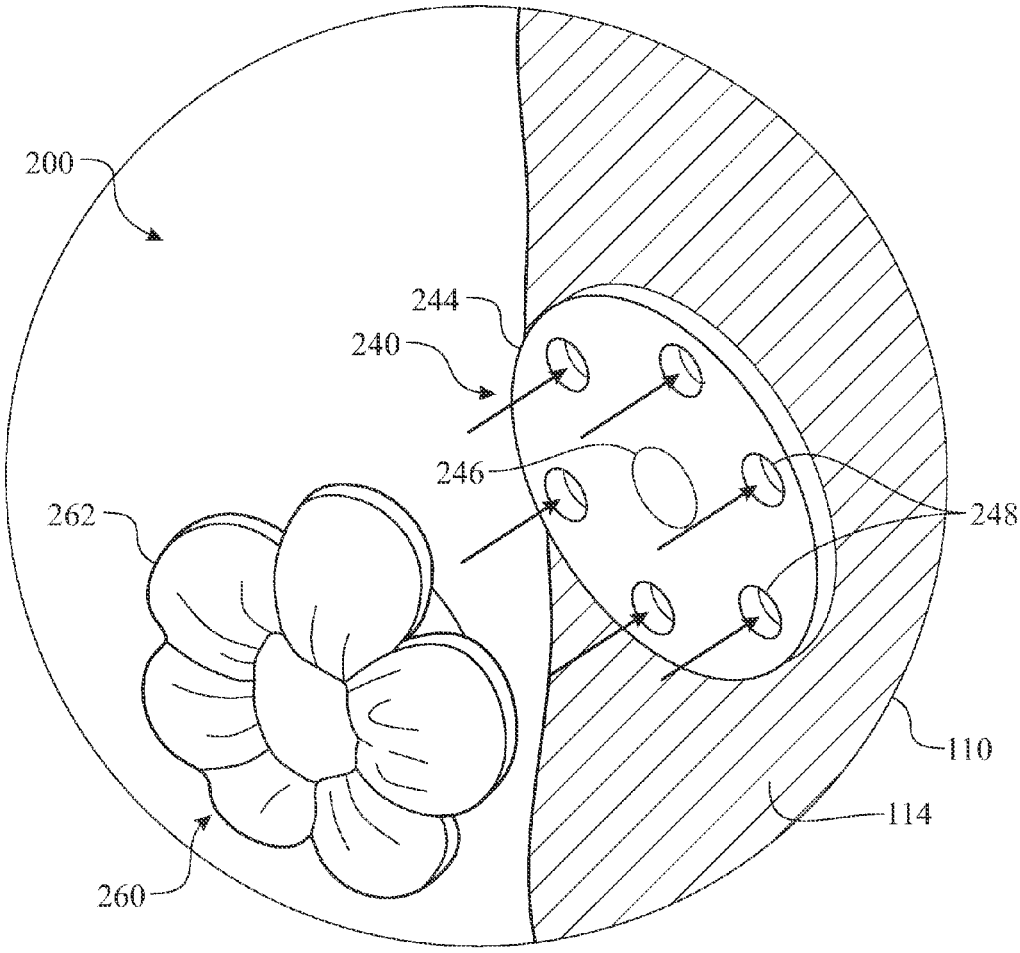
FIG. 2 presents a magnified isometric detail referenced as detail "A" in FIG. 1, illustrating an assembly step for assembling an interchangeable decorative adornment cover onto a fixed adornment attachment member.
Figure 3:
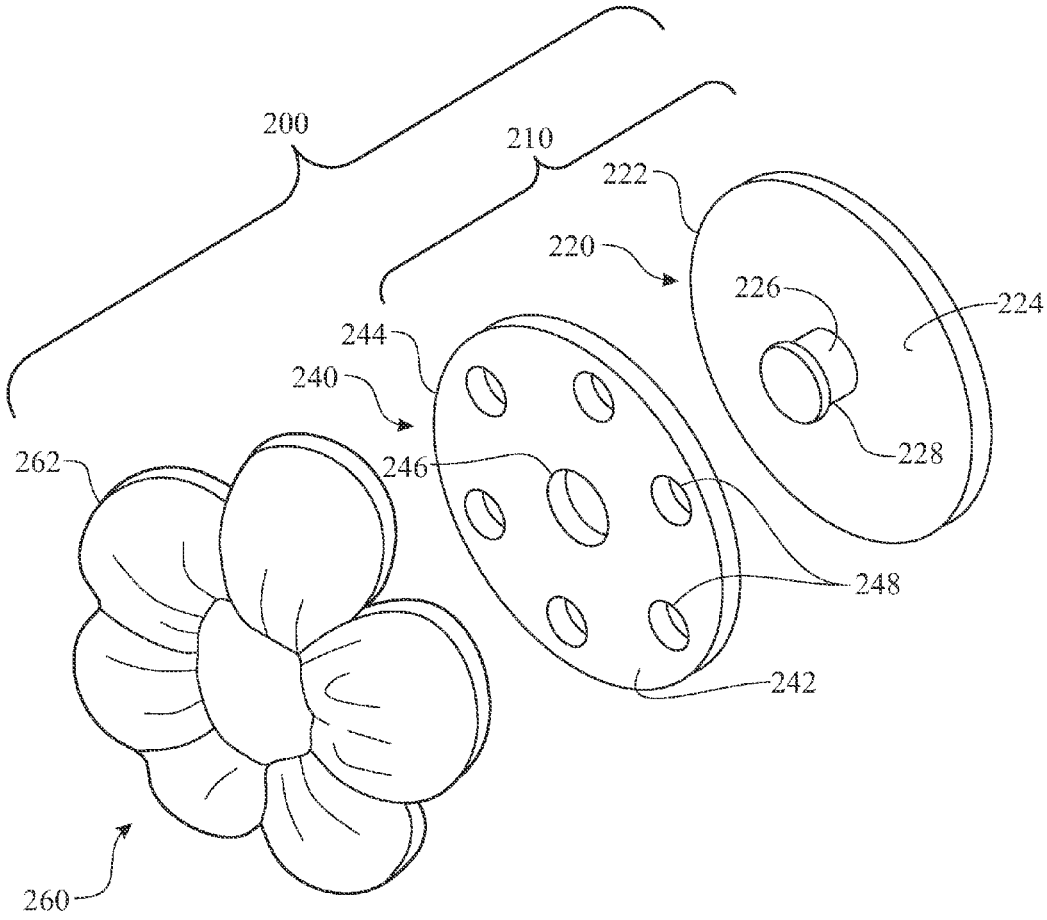
FIG. 3 presents an isometric exploded assembly view detailing an assembly of the an interchangeable decorative adornment cover and respective fixed decorative attachment receiving subassembly.
Figure 4:
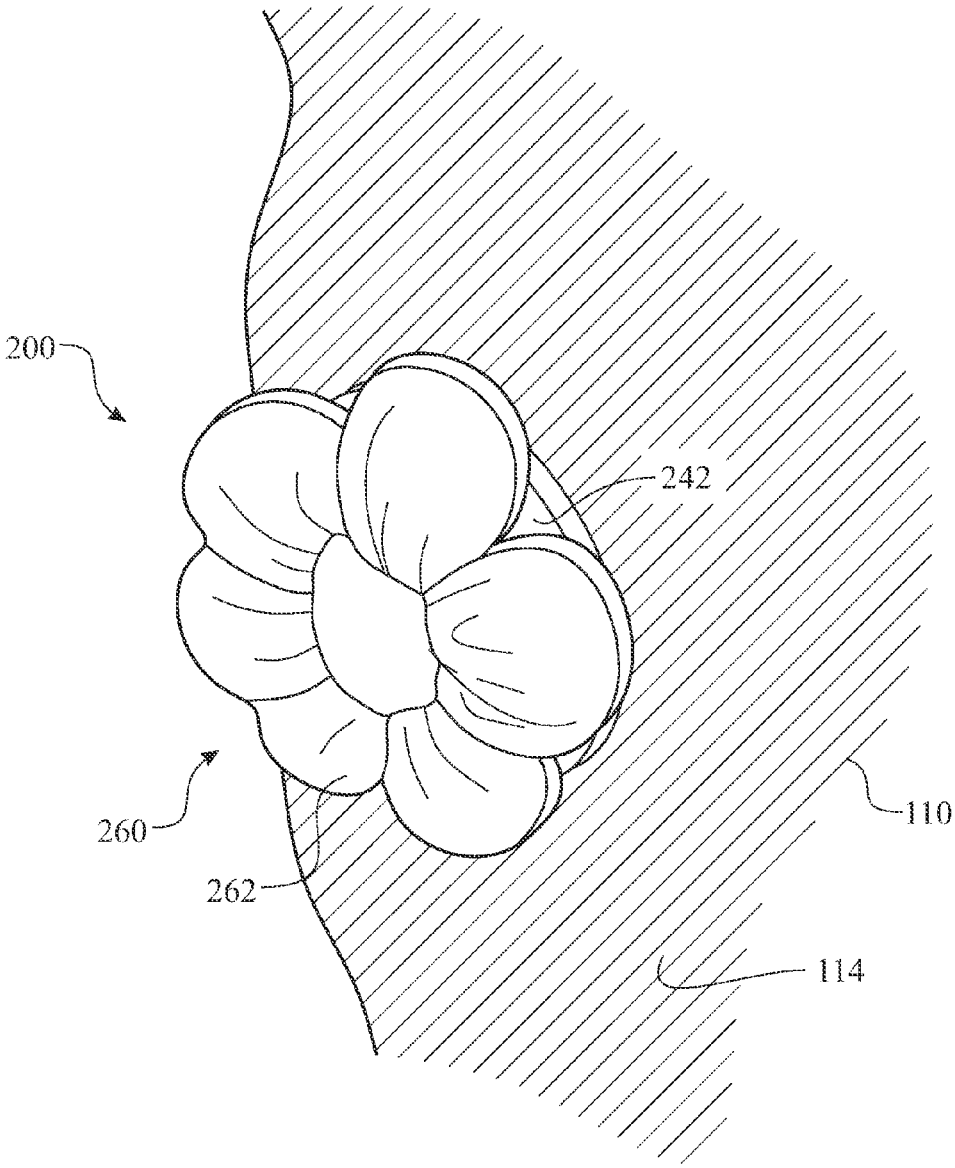
FIG. 4 presents an isometric view of the interchangeable decorative adornment cover and respective fixed adornment attachment member attached to a casual garment.
Figure 5:
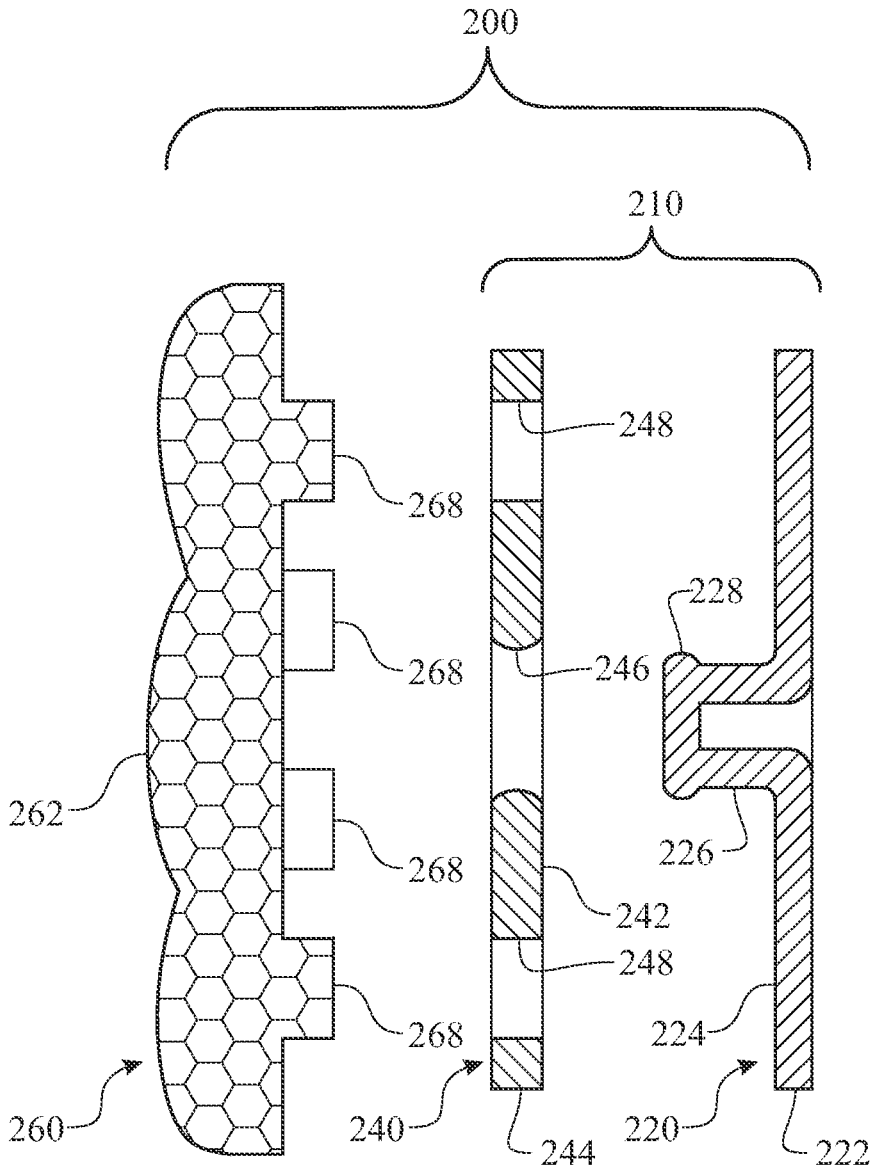
FIG. 5 presents a sectioned exploded assembly side view of the interchanging decorative adornment assembly.
Figure 6:
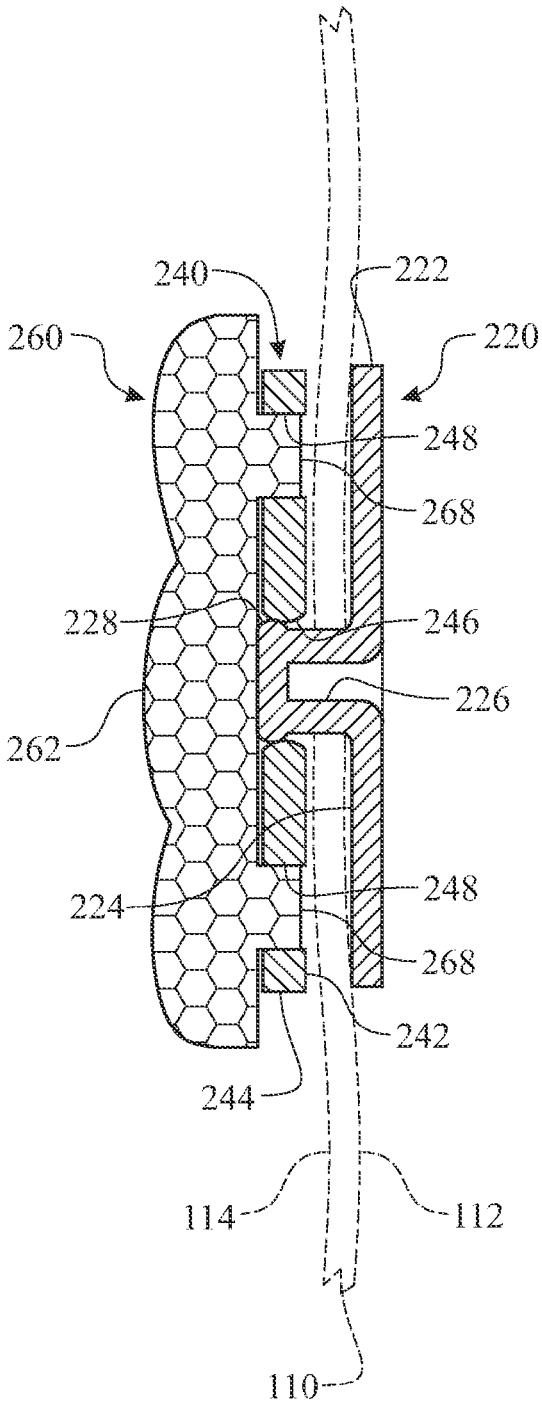
FIG. 6 presents a sectioned side view of the interchanging decorative adornment assembly assembled onto the casual garment.
Figure 7:
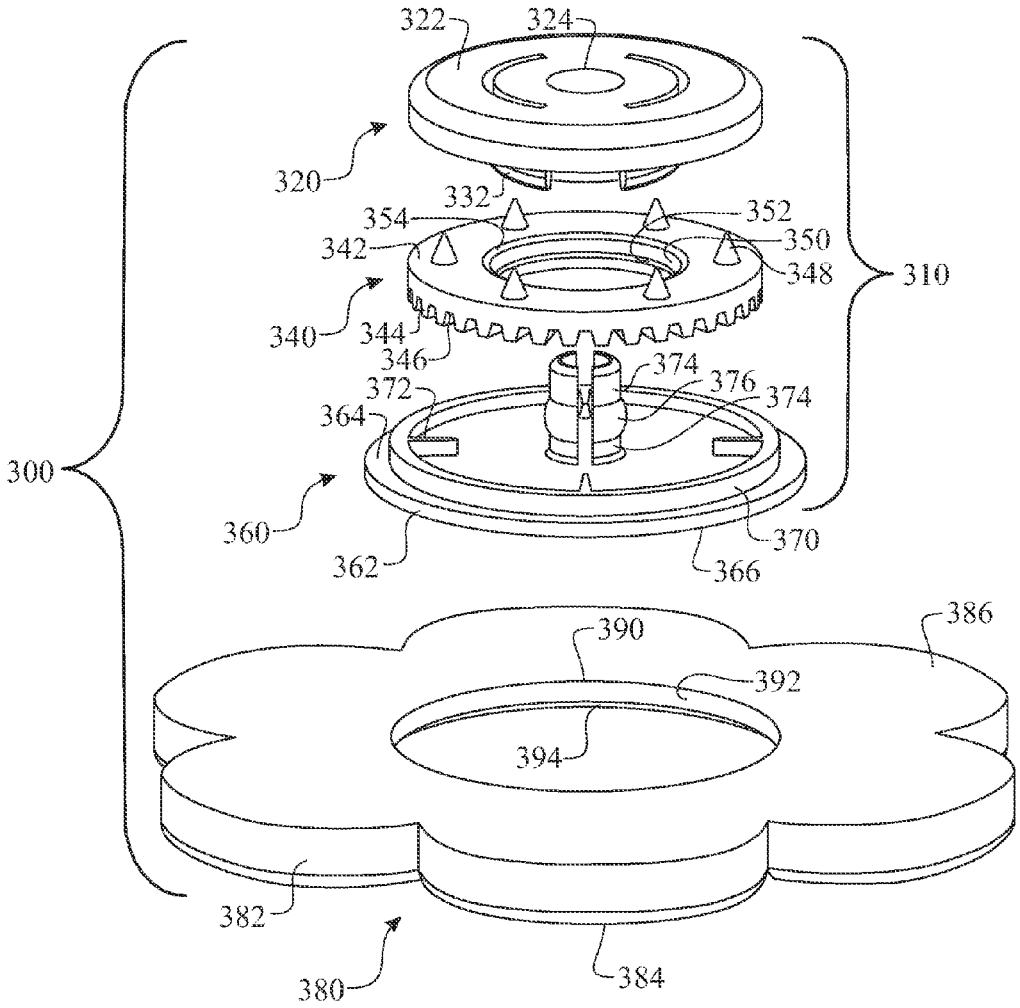
FIG. 7 presents an isometric exploded assembly rear view of an alternative exemplary interchanging decorative adornment assembly.
Figure 8:
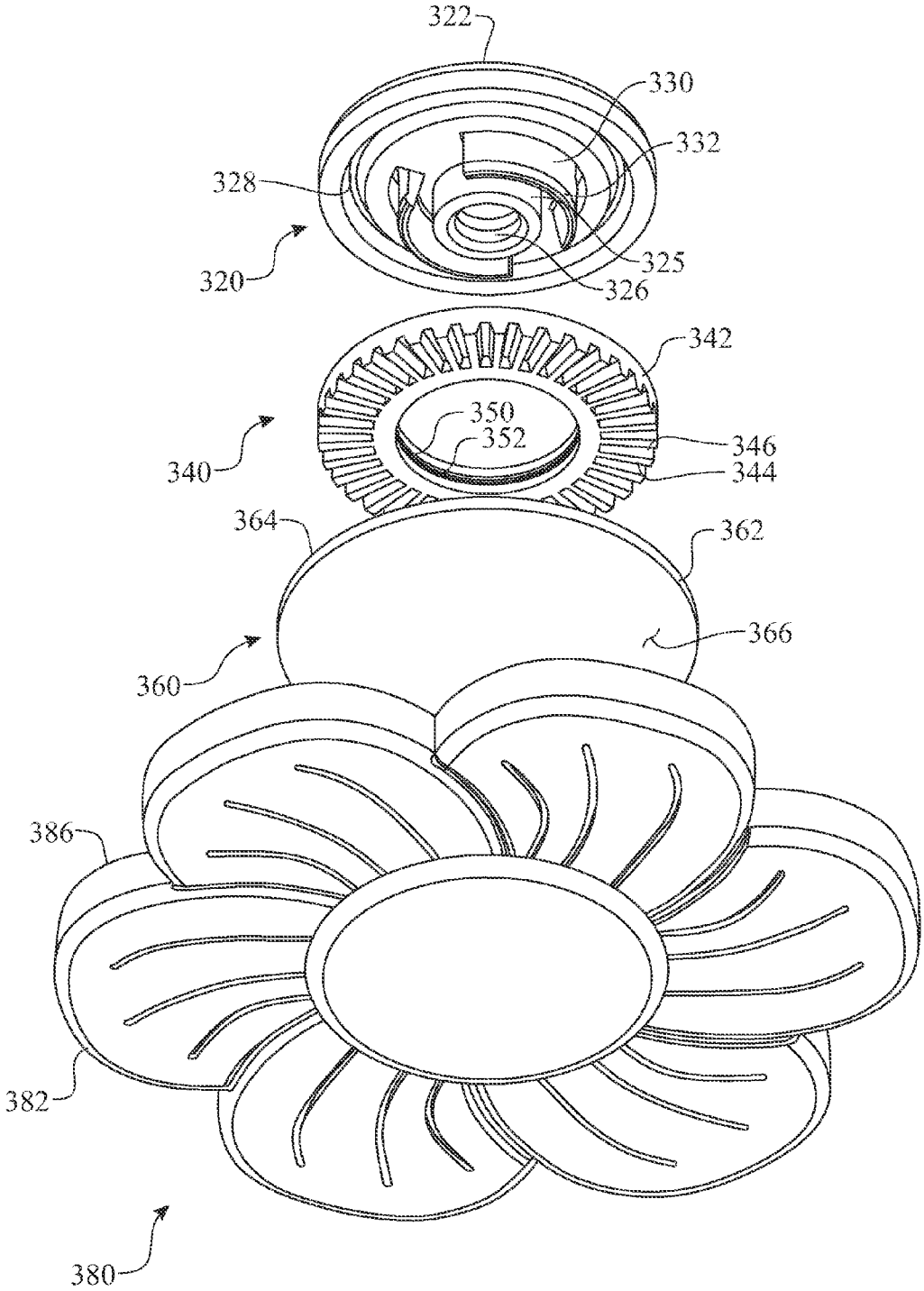
FIG. 8 presents an isometric exploded assembly front view of an alternative exemplary interchanging decorative adornment assembly previously introduced in FIG. 7.
Figure 9:
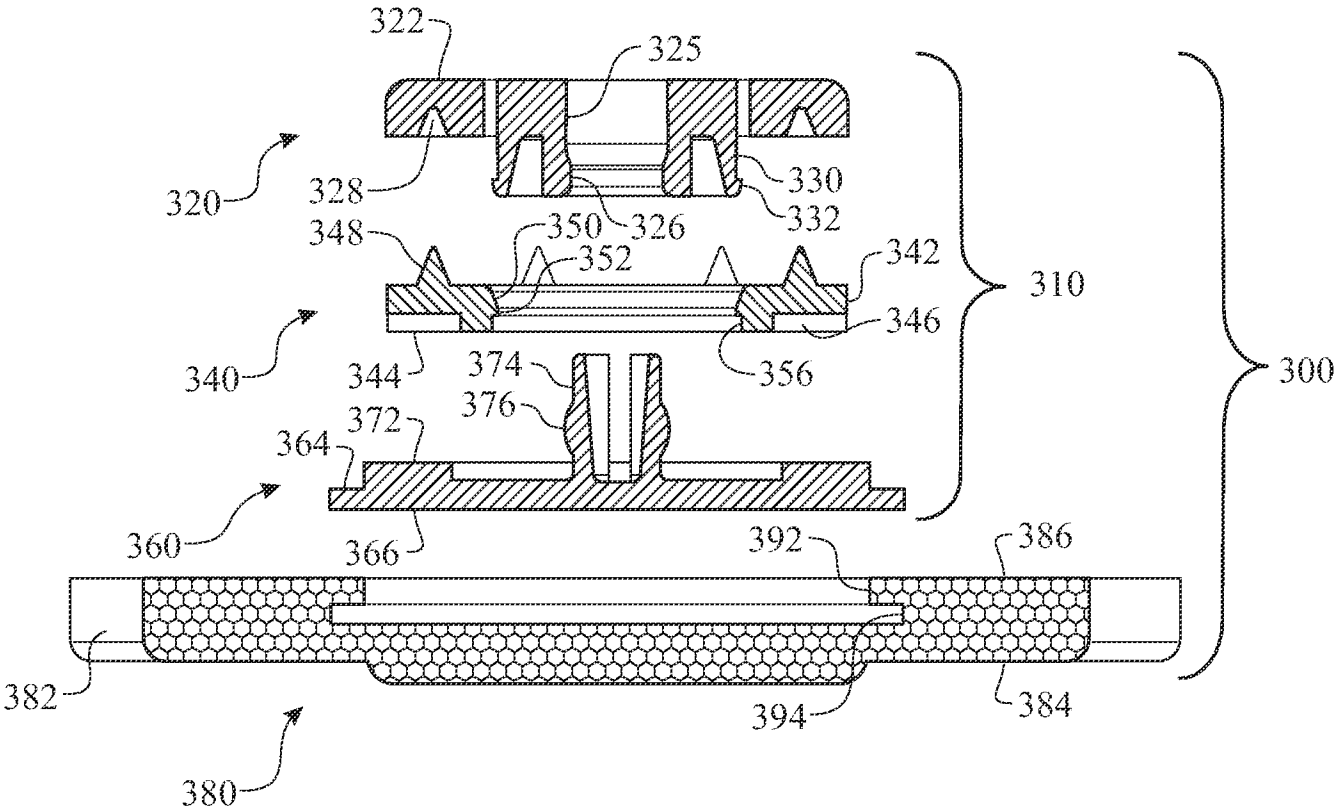
FIG. 9 presents a sectioned exploded assembly side view of the alternative exemplary interchanging decorative adornment assembly.
Figure 10:
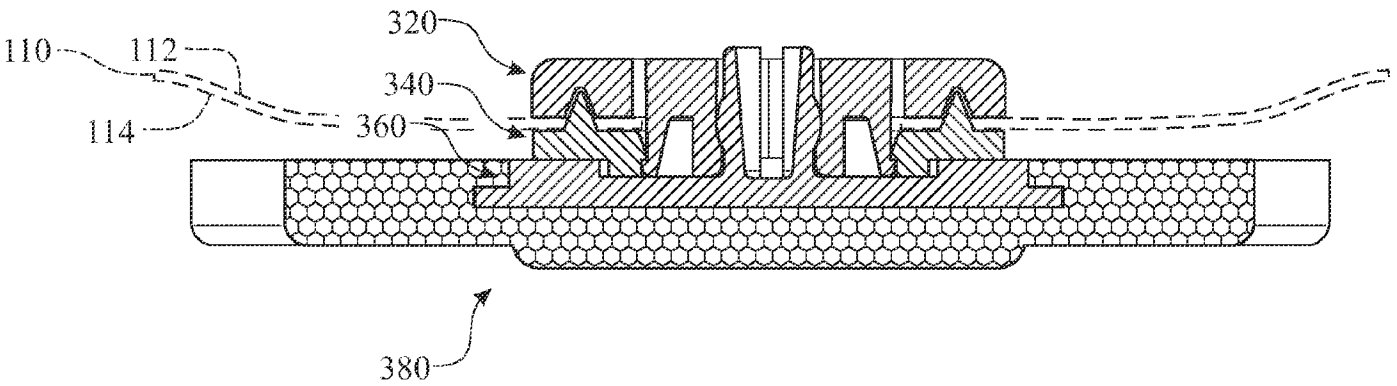
FIG. 10 presents a sectioned side view of the alternative exemplary interchanging decorative adornment assembly as it would be assembled onto the casual garment.

Repeat use of reference characters in the present specification and drawings is intended to represent the same or analogous features or elements of the invention.

DETAILED DESCRIPTION OF REPRESENTATIVE EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11:
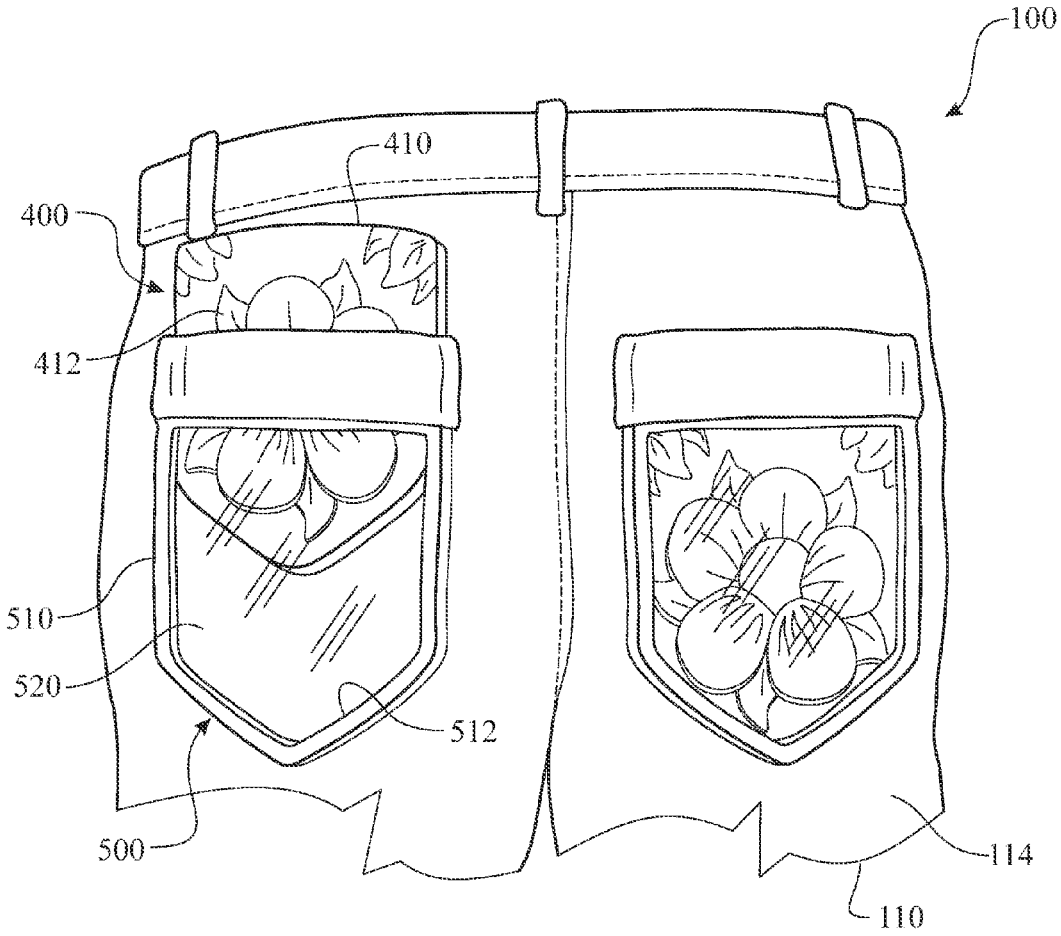
FIG. 11 presents an enlarged rear view of a hip region of a pair of casual pants, the illustration details the image enhancing pocket insert being inserted into the embellishment receiving pocket.
Figure 12:
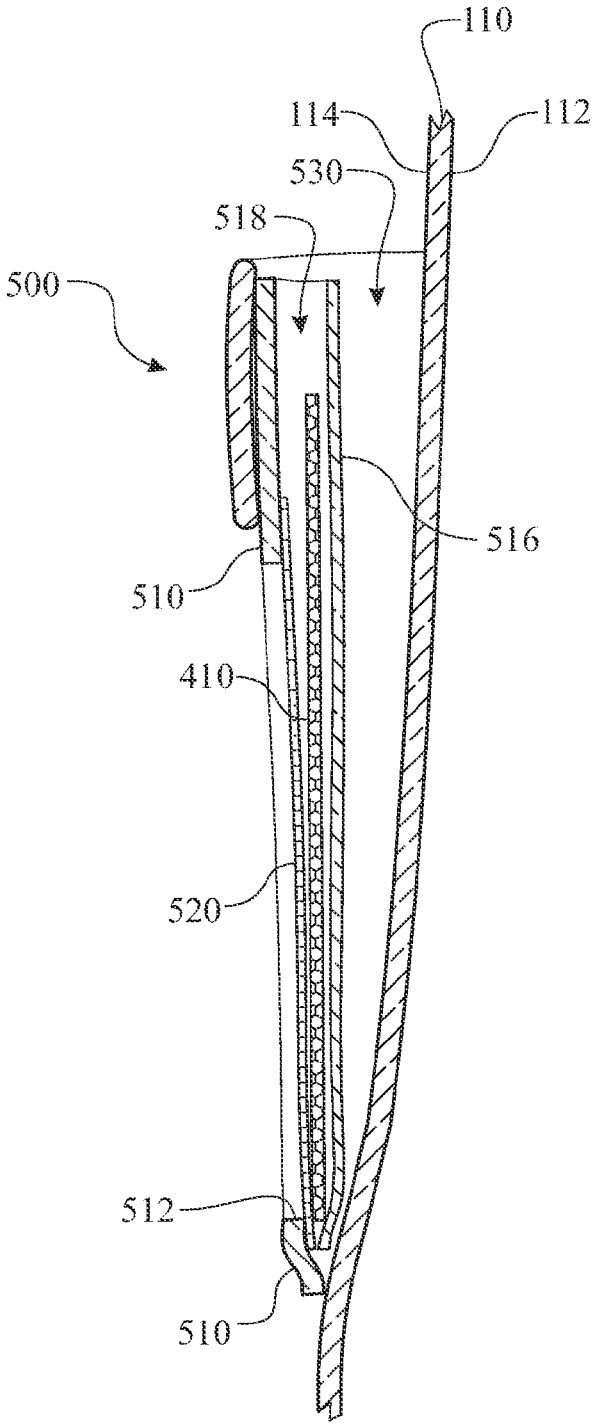
FIG. 12 presents a sectioned side view of an exemplary embellishment receiving pocket.
Figure 13:
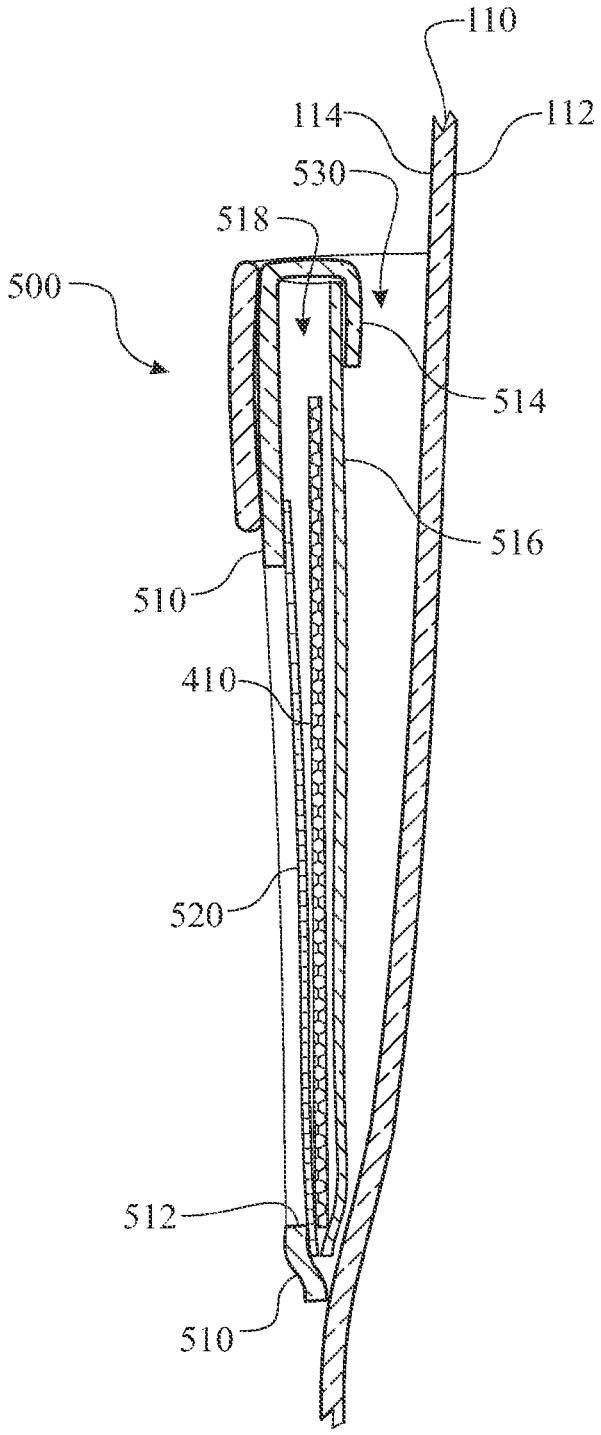
FIG. 13 presents a sectioned side view of an enhanced exemplary embellishment receiving pocket.

A casual garment 100 is presented as an exemplary pair of jeans or other casual pants wear as illustrated in FIG. 1. It is understood that throughout the disclosure, the casual garment 100 may be any other casual garment, including a shirt, jacket, shorts, skirts, dresses, and the like. The casual garment 100 includes two features that allow the wearer to personalize them. The first exemplary personalizing feature is a plurality of interchanging decorative adornment assembly 200, which are shown being attached along an outer seam and a hemline. Details of the interchanging decorative adornment assembly 200 are illustrated in FIGS. 2 through 6. An alternative exemplary embodiment of the interchanging decorative adornment assembly 200 is referenced as an interchanging decorative adornment assembly 300 (FIGS. 7-10). The second exemplary personalizing feature is a pair of image enhancing pocket inserts 400, which are inserted into a respective embellishment receiving pocket 500. Details of the embellishment receiving pocket 500 are illustrated in FIGS. 11 through 13.

The interchanging decorative adornment assembly 200 comprises an interchangeable decorative adornment cover 260, which is removably attached to a fixed adornment attachment member 240 of a fixed decorative attachment receiving subassembly 210. The fixed decorative attachment receiving subassembly 210 comprises an attachment backing member 220 and a fixed adornment attachment member 240. The attachment backing member 220 is fabricated having an affixing interface snap feature 228 disposed upon a distal end of an affixing interface axial member 226, where the affixing interface axial member 226 extends from a backing member contact surface 224 of a backing member body 222.

The fixed adornment attachment member 240 is fabricated having an affixing interface snap receiving feature 246 and a series of adornment attachment receiving features 248 formed through a fixed adornment attachment member body 242. The body is sized by a fixed adornment attachment member body peripheral edge 244 which is preferably smaller than the outer periphery of the interchangeable decorative adornment cover 260, thus remaining concealed by the interchangeable decorative adornment cover 260. The affixing interface snap receiving feature 246 is sized and shaped to mate with and positioned in registration with the affixing interface snap feature 228. At least one of the attachment backing member 220 and fixed adornment attachment member 240 can be fabricated having a resilient component allowing the affixing interface snap feature 228 to insert through the affixing interface snap receiving feature 246. The affixing interface snap feature 228 may be fabricated of a pliant material or shape, allowing the diameter to become reduced for insertion through the affixing interface snap receiving feature 246. The fixed adornment attachment member body 242 may be partially or completely formed having a plaint component, where the pliancy is provided about at least one of the affixing interface snap receiving feature 246 and/or the series of adornment attachment receiving features 248. Alternatively, the affixing interface snap feature 228 can be formed after insertion through the affixing interface snap receiving feature 246. The affixing interface snap feature 228 may be formed by a heating process, a reshaping process, a malleable process, and the like; the process being respective to the selected material. The attachment backing member 220 and fixed adornment attachment member 240 may be fabricated of a molded plastic, a formed plastic, a molded metal, a stamped metal, a cast metal, a formed composite, and the like. The exemplary term "plastic" can be used to reference plastic, nylon, glass impregnated plastic, rubber, silicone, and the like.

The fixed decorative attachment receiving subassembly 210 is affixed to apparel material 110 of the casual garment 100 by sandwiching the apparel material 110 between the attachment backing member 220 and the fixed adornment attachment member 240. A hole is created through the apparel material 110. The attachment backing member 220 is placed against a material inner surface 112, inserting an affixing interface snap feature 228 through the hole. The affixing interface snap feature 228 is engaged with the affixing interface snap receiving feature 246. It is preferred that the engagement between the attachment backing member 220 and fixed adornment attachment member 240 is permanent. The designer may assemble a single fixed decorative attachment receiving subassembly 210 to the casual garment 100 or a plurality of fixed decorative attachment receiving subassembly 210 in a random configuration, a patterned configuration, or both.

The consumer may obtain at least one interchangeable decorative adornment cover 260 for each fixed decorative attachment receiving subassembly 210 assembled to the casual garment 100. The interchangeable decorative adornment cover 260 may be provided with the casual garment 100 or offered separately, where the consumer selects the interchangeable decorative adornment cover 260 from a variety of offered designs. The interchangeable decorative adornment cover 260 is fabricated having an interchangeable cover aesthetic portion 262 shaped upon a visible side and an engagement interface on an assembly side. The interchangeable cover aesthetic portion 262 may be shaped, resembling any desirable objects, such as a flower, an animal, a button, a balloon, a letter, a number, a coin, a geometric shape, an instrument, a musical note, a vehicle, a logo, and the like. The interchangeable cover aesthetic portion 262 may be fabricated in a variety of colors, may include a variety of prints or designs, and the like. Various embellishments may be incorporated, include embedding gems, glass, and other items therein.

The interchangeable decorative adornment cover 260 is removably attached to the fixed adornment attachment member 240 by the engagement interface. In the exemplary embodiment, the interchangeable decorative adornment cover 260 comprises a plurality of adornment attachment features 268 extending from the assembly side thereof. The plurality of adornment attachment features 268 is provided in a shape, size, and arrangement for mating with the plurality of adornment attachment receiving features 248 in a secure, but detachable manner. The adornment attachment receiving feature 248 or adornment attachment feature 268 may be fabricated of a pliant material, allowing the adornment attachment receiving feature 248 or adornment attachment feature 268 to reshape, engage with, and retain the opposing component. It is also understood that the adornment attachment feature 268 may be of a rigid material and shaped as a compressible snap latch.

The design may allow the affixing interface snap feature 228 to remain flush with an exposed surface of the fixed adornment attachment member body 242 or a recess (not shown) can be provided within the assembly surface of the interchangeable decorative adornment cover 260 to accommodate a design where the affixing interface snap feature 228 stands proud of the exposed surface.

Multiple fixed decorative attachment receiving subassemblies 210 are attached in a spatial arrangement about the casual garment 100. The fixed decorative attachment receiving subassembly 210 may be positioned following the seams of the casual garment 100, configured in a pattern, or randomly dispersed.

An interchanging decorative adornment assembly 300, as illustrated in FIGS. 7 through 10, presents an enhanced embodiment of the interchanging decorative adornment assembly 200. The interchanging decorative adornment assembly 300 comprises an interchangeable decorative adornment cover 380, which is attached to a fixed decorative attachment receiving subassembly 310. The fixed decorative attachment receiving subassembly 310 includes an orientation member 340, which is assembled to a backing affixing member 320, sandwiching the apparel material 110 therebetween. A fixed adornment attachment member 360 is subsequently assembled to the backing affixing member 320, completing the fixed decorative attachment receiving subassembly 310.

The backing affixing member 320 is fabricated comprising a backing affixing member body 322 and an affixing interface snap receiving feature 324. The affixing interface snap receiving feature 324 includes an affixing interface snap receiving tubular section 325 extending from an assembly side of the backing affixing member body 322 and forms an affixing interface snap receiving tubular section interior 326 therein. An orientation affixing interface snap feature 332 is provided upon a distal end of an orientation affixing interface snap cantilever 330 extending from the assembly side of the backing affixing member body 322. The affixing interface snap receiving tubular section 325 is sized having a first diameter. The orientation affixing interface snap cantilever 330 is sized having a second diameter. In the exemplary embodiment, the affixing interface snap receiving tubular section 325 is centrally located within the orientation affixing interface snap cantilever 330. An orientation pin receiving ring 328 is provided as a recession about a perimeter of the assembly side of the backing affixing member body 322.

The orientation member 340 is fabricated comprising an orientation member body 342 having a series of orientation retaining teeth 344 and orientation retaining recession 346 provided in an alternating arrangement disposed about a perimeter of an external surface thereof. An orientation affixing interface snap receiving aperture 350 is provided through a central portion of the orientation member body 342 and in registration with the orientation affixing interface snap cantilever 330. An orientation affixing interface snap receiving channel 352 is integrated within the orientation affixing interface snap receiving aperture 350 for securing the orientation affixing interface snap feature 332 therein. An orientation affixing interface snap receiving aperture chamfer 354 may be provided about an assembly side of the orientation affixing interface snap receiving aperture 350 to aid in the insertion of the orientation affixing interface snap feature 332. Multiple orientation retaining pins 348 are spatially arranged and extending away from the assembly surface of the orientation member body 342. The orientation retaining pins 348 are positioned to align and seat within the orientation pin receiving ring 328. The retaining pins 348 are representative of any frictional interface and/or mechanical interface designed to engage with the material 110 and maintain the orientation retaining member 340 (or the fixed adornment attachment member 360 where assembled directly) in an assembled orientation.

The fixed adornment attachment member 360 is fabricated comprising a fixed adornment attachment member body 362. The fixed adornment attachment member body 362 is formed in a disc shape. A registration ring 370 defines a fixed adornment attachment ridge upper surface 364 of the fixed adornment attachment member body 362. A fixed adornment attachment ridge lower surface 366 is sized and shaped for insertion into an interchangeable adornment cover mount aperture 390 of the interchangeable decorative adornment cover 380, with the exemplary embodiment being planar. It is understood that the fixed adornment attachment ridge lower surface 366 may be concave to aid in the assembly of the interchangeable decorative adornment cover 380 onto the fixed adornment attachment member 360. At least one registration mating teeth 372 is included proximate and preferably extending radially inward from an interior edge of the registration ring 370. The registration mating teeth 372 is sized and shaped to mate with the orientation retaining recession 346. A fixed adornment affixing interface snap cantilever 374 extends outward in a perpendicular arrangement from a central location of the assembly surface of the fixed adornment attachment member body 362. The fixed adornment affixing interface snap cantilever 374 is divided into two cantilevered members spatially arranged to flex together during an assembly process. A latching feature, such as a fixed adornment affixing interface bulbous feature 376, engages with the affixing interface snap receiving tubular section interior 326, which maintains the assembly between the fixed adornment attachment member 360 and the backing affixing member 320. The fixed adornment attachment ridge upper surface 364 preferably stands proud when the fixed decorative attachment receiving subassembly 310 is assembled and secured to the apparel material 110.

The interchangeable decorative adornment cover 380 is fabricated having an interchangeable adornment cover body 382. The interchangeable adornment cover body 382 is defined having an interchangeable adornment cover adornment surface 384 on a visible side and an interchangeable adornment cover mount surface 386 on an opposite side. The interchangeable adornment cover adornment surface 384 and respective outline may be designed to present any reasonable object, such as a flower, an animal, a letter, a number, a coin, a geometric shape, an instrument, a musical note, a vehicle, a logo, any combination or plurality of the same, and the like. The interchangeable adornment cover adornment surface 384 may be fabricated having a single color, multiple colors, include a printed indicia, and the like to enhance the representation. An interchangeable adornment cover mount aperture 390 is incorporated into an assembly side of the interchangeable decorative adornment cover 380. The interchangeable adornment cover mount aperture 390 includes an interchangeable adornment cover mount aperture sidewall 392 continuing into an interchangeable adornment cover mount aperture keyway 394.

The fixed decorative attachment receiving subassembly 310 is assembled to the apparel material 110 by first perforating the apparel material 110 and creating a hole having a diameter proximate an effective diameter of the orientation affixing interface snap cantilever 330. The backing affixing member 320 is located against the material inner surface 112 and the orientation affixing interface snap cantilever 330 is inserted through the hole. The orientation member 340 is assembled to the backing affixing member 320 by inserting the orientation affixing interface snap cantilever 330 through the orientation affixing interface snap receiving aperture 350 until the orientation affixing interface snap feature 332 engages with the orientation affixing interface snap receiving channel 352. An optional orientation affixing interface snap receiving aperture chamfer 354 may be included to aid in guiding and compressing the orientation affixing interface snap feature 332 into the orientation affixing interface snap receiving aperture 350. Upon complete insertion, the orientation affixing interlace snap cantilever 330 expands, securing the orientation affixing interface snap feature 332 against a lip of an orientation affixing interface snap receiving ridge 356, thus securing the orientation member 340 and the backing affixing member 320 together. The series of orientation retaining pin 348 deform and/or perforate the apparel material 110 to maintain the orientation of the orientation member 340 throughout the life of the adorned garment. The orientation pin receiving ring 328 provides a clearance to receive the orientation retaining pin 348. The orientation pin receiving ring 328 may be formed as a circular recess, individual recesses, and the like to mate with the respective orientation retaining pins 348. The fixed adornment attachment member 360 is located from a material visible surface 114 and attached to the backing affixing member 320 by inserting the fixed adornment affixing interface snap cantilever 374 into the affixing interface snap receiving feature 324 and continuously inserted until the fixed adornment affixing interface bulbous feature 376 engages with a distal surface of the affixing interface snap receiving tubular section interior 326. The fixed adornment affixing interface snap cantilever 374 compresses together during the insertion process and returns to a natural, expanded configuration after the fixed adornment affixing interface bulbous feature 376 passes across the affixing interface snap receiving tubular section interior 326. During the insertion process, the registration mating teeth 372 engages within the orientation retaining recession 346, Should the user desire to rotate the fixed adornment attachment member 360, the user would pull the fixed adornment attachment member 360 away from the orientation member 340, where the fixed adornment affixing interface snap cantilever 374 feature acts as a spring. This allows for temporary disengagement between the registration mating teeth 372 and the orientation retaining recession 346 allowing rotation of the fixed adornment attachment member 360.

It is understood that the orientation member 340 may be omitted and the fixed adornment attachment member 360 may include assembly features of the orientation member 340.

The interchangeable decorative adornment cover 380 is removable attached to the fixed adornment attachment member 360. The exposed portion of the fixed adornment attachment member 360 is inserted into the interchangeable adornment cover mount aperture 390, seating the peripheral edge into the interchangeable adornment cover mount aperture keyway 394. The fixed adornment attachment member body 362 seats against a contact side edge of the interchangeable adornment cover mount aperture keyway 394 maintaining an axial assembly and the peripheral edge of the registration ring 370 seats against the interchangeable adornment cover mount aperture sidewall 392 maintaining a lateral position. At least one of the interchangeable adornment cover mount aperture 390 and the fixed adornment attachment member body 362 are pliant, whereby the pliant material reshapes allowing the insertion of the fixed adornment attachment member body 362 into the interchangeable adornment cover mount aperture 390.

The interchangeable decorative adornment cover 380 can be enhanced with the inclusion of lights, LEDS, or similar; glow in the dark material or chemicals; color changing properties, inks and the like; and any of a variety of other options.

Continuing with the adornment, the casual garment 100 can include an embellishment receiving pocket 500. The embellishment receiving pocket 500 is commonly attached to a rear seat of a pair of pants, a front portion of a shirt or jacket, and the like for displaying an image provided upon a decorative pocket insert 410. The decorative pocket insert 410 is preferably fabricated of a thin, semi-flexible material, having an image disposed upon at least one surface, such as a heavy paper-based material, aplastic material, a metallic material, and the like. It is understood that the decorative pocket insert 410 may be fabricated of a more rigid material that is arched to contour to a respective shape of an individual. The decorative pocket insert 410 is sized and shaped to fit into and contour to the interior perimeter of the pocket frame 510. The image can be a common printed design, a three-dimensionally shaped surface (monochrome, multi-colored, printed upon, and the like), a Lenticular Hologram, and the like. The embellishment receiving pocket 500 is fabricated including a pocket frame 510 comprising a pocket frame central opening 512. The preferred shape of the pocket frame 510 comprises a narrow outline or frame about a perimeter of the embellishment receiving pocket 500. A transparent pocket fascia 520 is layered against an assembly surface of the pocket frame 510 and sized to completely cover the pocket frame central opening 512. A pocket insert receptacle rear member 516 is assembled between the transparent pocket fascia 520 and the material visible surface 114 of the apparel material 110. The pocket is joined to the apparel material 110 by any common joining method, such as stitching, adhesive, and the like, following a pocket contour. The attachment is provided along each of a left and right side edge and continuing across a bottom edge therebetween. An upper edge of the pocket frame 510 remains unattached respective to the apparel material 110 to form an insert receptacle 518. Similarly, an upper edge of the pocket insert receptacle rear member 516 also remains unattached respective to the apparel material 110 to form a standard pocket receptacle 530. The decorative pocket insert 410 is inserted into the insert receptacle 518. The decorative pocket insert 410 includes an image on at least one side. The decorative pocket insert 410 is inserted into the insert receptacle 518 oriented having the image side contacting and visible through the transparent pocket fascia 520. The pocket insert receptacle rear member 516 supports and protects the decorative pocket insert 410, isolating the decorative pocket insert 410 from objects inserted into a standard pocket receptacle 530.

The decorative pocket insert 410 can be retained within the insert receptacle 518 by friction, a fastener provided proximate an upper edge of the insert receptacle 518 or the inclusion of an insert receptacle cover flap 514 (FIG. 13) which is retained covering an opening across the upper edge of the insert receptacle 518, and the like. The fastener can be any reasonable fastener, including mating sections of a dense hook and loop tape interface, a snap, a button and buttonhole, and the like.

The various adornments presented herein provide the person wearing the casual garment 100, the ability to individualize the casual garment 100 by attaching an interchangeable decorative adornment cover 260, 380 suiting their mood or desired appearance and inserting a decorative pocket insert 410 selected from the available collection of decorative pocket inserts 410. The individual may use interchangeable decorative adornment covers 260, 380 having similar appearances; different appearances; those having an appearance when placed in a series to create a word, phrase, and the like; those having an appearance when placed in a series to create a storyboard; and the like.

The various interchangeable adorning components may be sold individually, in sets, included with the casual garment 100, and the like. This offers the owner the ability to continuously change their wardrobe without the expense of new garments.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A decorative accessory for individualizing a casual garment, the decorative accessory comprising:

an interchangeable decorative adornment cover (380) comprising an interchangeable adornment cover body (382) having a decorative formation on an exterior surface of the interchangeable decorative adornment cover and an interchangeable adornment cover mount feature (390) integrated on an attachment surface of the interchangeable decorative adornment cover; and a fixed decorative attachment receiving subassembly comprising:

a fixed adornment attachment member (360) comprising:

a fixed adornment attachment member body (362), a fixed adornment affixing interface member (374,376) extending generally perpendicularly from a center of the fixed adornment attachment member body (262), and a registration feature (372) integrated into an upper surface of the fixed adornment attachment member body (362);

an orientation member (340) comprising:

an orientation member body (342) having an annular shape comprising an orientation affixing interface snap receiving aperture (350) passing concentrically therethrough, extending generally perpendicularly from a center of the fixed adornment attachment member body (262);

an orientation retaining feature (344, 346) integrated into the orientation member body (342), wherein the orientation retaining feature (344, 346) selectively engages with the registration feature (372) to temporarily retain orientation of the fixed adornment attachment member (360) respective to the orientation member 340 when the fixed adornment attachment member (360) is rotated about a central longitudinal axis of the fixed adornment affixing interface member (374,376); and a backing affixing member (320) comprising:

a backing affixing member body (322), an orientation affixing interface snap feature (332) integrated into the backing affixing member body (322), and an affixing interface snap receiving feature (324) centrally integrated with the backing affixing member body (322);

wherein the attachment backing member (320) and the orientation member (340) are assembled to one another sandwiching material of a casual garment therebetween by engaging the orientation affixing interface snap feature (332) with the orientation affixing interface snap receiving aperture (350), and wherein the fixed adornment attachment member (360) and the backing affixing member (320) are assembled to one another positioning the orientation member (340) therebetween by inserting and rotationally engaging the interface receiving feature (324) with the fixed adornment affixing interface member (374,376), thus enabling the fixed adornment attachment member (360) to rotate respective to the backing affixing member (320), wherein the interchangeable decorative adornment cover is removably attached to the fixed adornment attachment member by engaging the concealed attachment feature interchangeable adornment cover mount feature (390) and the an orientation member (340) with one another.

2. A decorative accessory for individualizing a casual garment as recited in claim 1, wherein the fixed adornment attachment member body extends proud from an exterior surface of the garment material, the fixed adornment attachment member body (362) further comprising a ridge formed about a peripheral edge thereof, the ridge comprising an upper surface (364) and a lower surface (366); and the interchangeable adornment cover mount feature (390) further comprising a interchangeable adornment cover mount aperture, the cover mount aperture having an interchangeable adornment cover mount aperture sidewall continuing into an interchangeable adornment cover mount aperture keyway, wherein fixed adornment attachment member body ridge is inserted into the interchangeable adornment cover mount aperture and the fixed adornment attachment member body ridge is seated within interchangeable adornment cover mount aperture keyway.

3. A decorative accessory for individualizing a casual garment as recited in claim 2, wherein at least one of the following is fabricated of a pliant material:

a region of the interchangeable adornment cover mount feature (390) comprising the interchangeable adornment cover mount aperture, and the fixed adornment attachment member body ridge.

4. A decorative accessory for individualizing a casual garment as recited in claim 1, wherein the orientation member (340) further comprises an orientation retaining feature (348), wherein the orientation retaining feature (348) provides at least one of a frictional interface and a mechanical interface designed to engage with the material and maintain the orientation member in an assembled orientation.

5. A decorative accessory for individualizing a casual garment as recited in claim 1, wherein both an interior surface of the fixed decorative attachment receiving subassembly and an exterior surface of the fixed decorative attachment receiving subassembly further are planar when the fixed decorative attachment receiving subassembly is assembled to the material.

6. A decorative accessory for individualizing a casual garment as recited in claim 1, wherein the interchangeable decorative adornment cover is shaped to resemble one of an object, a letter, a number, a geometric shape.

7. A decorative accessory for individualizing a casual garment as recited in claim 6, wherein an appearance of the interchangeable decorative adornment cover is further enhanced with at least one of:

a printed surface,
a painted surface,
a colored material,
a shaped outline, and
three dimensionally shaped.

* * * * *